US005149090A

United States Patent [19]

Chen et al.

[11] Patent Number: 5,149,090

[45] Date of Patent: Sep. 22, 1992

[54] VIBRATION DAMPING DEVICE FOR SPORTS RACQUET

[76] Inventors: Sam H. Chen, 13947 Carriage Rd., Poway, Calif. 92064; C. F. Chang, 403, Sec. 2, Sha-Tzen Road, Ta-Tu, Taichung Hsien, Taiwan

[21] Appl. No.: 814,494

[22] Filed: Dec. 30, 1991

[51] Int. Cl.[5] ..... A63B 51/10

[52] U.S. Cl. ..... 273/73 D; 273/73 R

[58] Field of Search ..... 273/73 R, 73 A, 73 B, 273/73 C, 73 D, 73 E

[56] References Cited

U.S. PATENT DOCUMENTS

| | | | |
|---|---|---|---|
| 2,732,209 | 1/1956 | Forbes | 273/73 |
| 3,899,172 | 8/1975 | Vanghn et al. | 273/73 |
| 3,941,380 | 3/1976 | Lacoste | 273/73 |
| 4,180,265 | 12/1979 | Staufer | 273/73 |
| 4,330,125 | 5/1982 | Sassler | 273/73 |
| 4,353,551 | 10/1982 | Ariech | 273/73 |
| 4,364,564 | 12/1982 | Lewis | 273/29 |
| 4,368,886 | 1/1983 | Graf | 273/73 D |
| 4,458,898 | 7/1984 | Boden | 273/73 D |
| 4,509,750 | 4/1985 | Last | 273/29 |
| 4,575,083 | 3/1986 | Adam | 273/73 |
| 4,609,194 | 9/1986 | Krent et al. | 273/73 |
| 4,732,383 | 3/1988 | Ferrari | 273/73 |
| 4,863,168 | 9/1989 | Anderka et al. | 273/73 D |
| 4,911,445 | 3/1990 | Ferrari et al. | 273/73 R X |
| 4,927,143 | 5/1990 | Hillock | 273/73 D |
| 4,962,928 | 10/1990 | Camara et al. | 273/73 R X |
| 5,096,194 | 3/1992 | Yong et al. | 273/73 R X |

FOREIGN PATENT DOCUMENTS

| | | | |
|---|---|---|---|
| 0208639 | 11/1986 | European Pat. Off. | 273/73 R |
| 2633070 | 1/1978 | Fed. Rep. of Germany | 273/73 D |
| 2642694 | 3/1978 | Fed. Rep. of Germany | 273/73 D |
| 3123690 | 3/1983 | Fed. Rep. of Germany | 273/73 |
| 3620083 | 12/1987 | Fed. Rep. of Germany | 273/73 D |
| 8901809 | 3/1989 | World Int. Prop. O. | 273/73 D |

*Primary Examiner*—V. Millin
*Assistant Examiner*—William E. Stoll
*Attorney, Agent, or Firm*—Calif Tervo

[57] ABSTRACT

A vibration damping device (10) for a sports racquet, such as a common tennis racquet (50), having sets of interwoven strings (71) defining a striking surface (70) generally comprises an elongated elastic flexible band (20) and securing hooks (40) slidingly attached from the side to the band's ends (21,22) for securing the band (20) in a stretched interwoven relationship with a plurality of strings (71) on the racquet striking surface (70). A plurality of U-shaped channels (30) are each adapted for receiving an interwoven string (71).

19 Claims, 1 Drawing Sheet

VIBRATION DAMPING DEVICE FOR SPORTS RACQUET

BACKGROUND OF THE INVENTION

1. Field of the Invention

This invention relates to vibration damping in a sports racquet, such as a tennis racquet, having a strung striking surface, and more specifically involves a flexible elastic band device for interweaving in the strings and including channels for receiving the strings for damping vibrations in the strings.

2. Background of the Invention

A conventional sports racquet, such as a tennis racquet, has a striking surface formed by two intersecting sets of parallel spaced strings attached to and enclosed by an oval-shaped head portion of the racquet to which a handle is attached. One set of strings, the main strings, runs longitudinally, generally parallel to the handle, and the other set of strings, the cross strings, generally runs transversely, generally normal to the handle axis. When a ball or other object is struck by the strung playing surface, vibrations are produced.

U.S. Pat. No. 4,911,445 of Ferrari describes a string vibration damping device. The device is an elastic tube having a central bore containing a vibration damping fluid. Attaching hook plug into each end of the bore. The device is typically interwoven about one end of the main strings.

The prior art device suffers from a number of disadvantages. Devices containing liquid are easily damaged, such as by a miss hit ball, and this commonly results in rupture and undesirable leaking of the contained liquid. Also, tube end plugs, since they attach axially, are easily dislodged during play. This results in a flailing strap and expulsion of the contained liquid. Additionally, such a tube has only a small contact area with the string. This limits the rate at which vibration energy that can be absorbed.

Therefore, it would be desirable to have a vibration damping device capable of absorbing vibrational energy at a faster rate.

It is further desirable that such as device include securing fasteners that do not attach axially so that tension forces cannot dislodge them.

SUMMARY OF THE INVENTION

This invention is a vibration damping device for a sports racquet, such as a common tennis racquet, having sets of interwoven strings defining a striking surface. The damping device generally comprises an elongated elastic flexible band having a longitudinal axis and securing hooks attached to the ends of the band for securing the band in a stretched condition to a tennis racquet in an interwoven relationship with a plurality of strings on the racquet striking surface. The band further includes a plurality of channels therein, each channel including side walls. Each channel adapted for receiving a string interwoven with the band such that the channel side walls bear against opposite sides of the string.

In a preferred embodiment, the band is substantially rectangular in transverse cross-section and the channels traverse the width of the band.

In the exemplary embodiment, the channels are substantially U-shaped in cross section.

According to another aspect of the invention, the ends of the band are adapted for sliding attachment from the side of the securing hook.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
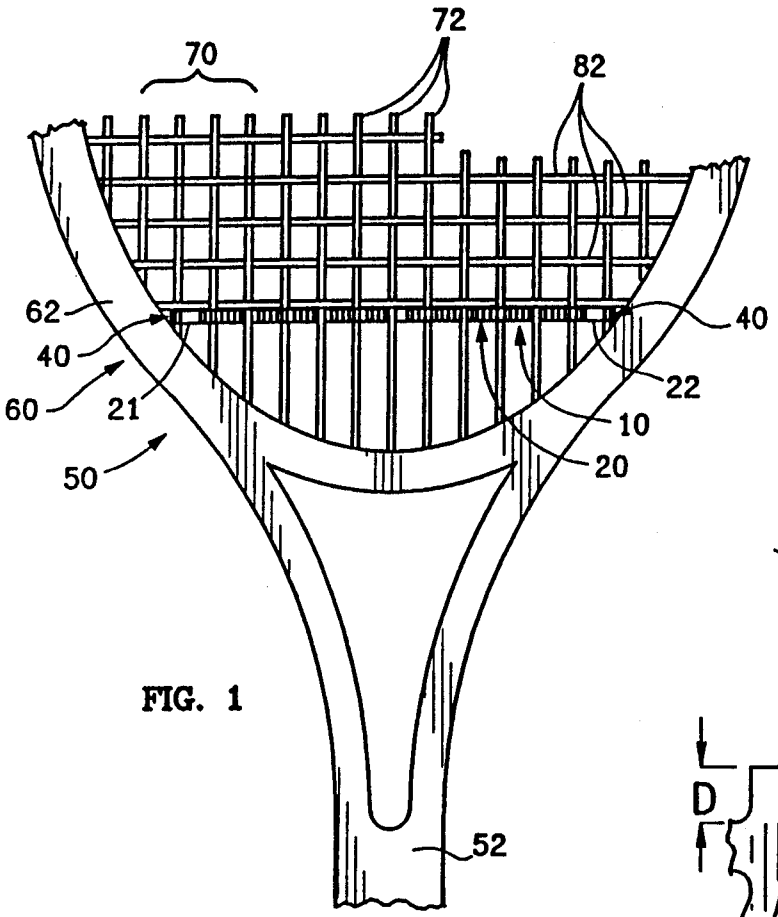
FIG. 1 is a partial plan view of a tennis racquet having a partially shown striking surface to which a preferred embodiment of the vibration damping device of the invention is mounted.

With reference now to the drawing, and more particularly to FIG. 1, there is shown a partial plan view of a tennis racquet, denoted generally as 50, including a strung striking face or surface, denoted generally as 70, also shown in partial view. A preferred embodiment of the vibration damping device of the invention, denoted generally as 10, is shown attached to striking face 70.

Although a tennis racquet is illustrated and described, it is understood that damping device 10 is applicable to other appropriately strung racquets.

Tennis racquet 50 is of common design having a handle 52 attached to a generally oval-shaped head, denoted generally as 60, shown in partial plan view. Head 60 includes a frame 62 which forms a closed loop.

Striking surface 70 is comprised strings 71 including a first set of strings, main strings 72, and a second set of strings, cross strings 82. Main strings 72 are spaced apart and extend generally parallel to one another across head frame 62 and are oriented generally parallel to the longitudinal axis of the handle. Cross strings 82 are spaced apart and extend generally parallel to one another across head frame 62 and are generally oriented at right angles to main strings 72 and to the longitudinal axis of handle 52. Both sets of strings 72,82 criss-cross one another and are interwoven with one another. Note that although the term strings is used, each string set is typically composed of a single string that is repeatedly woven through frame 62.

Vibration damping device 10 generally comprises a elongated band, denoted generally as 20, made of elastic flexible material and having first and second ends 21,22 and securing means, such as hook fasteners, denoted generally as 40, attached to each band end 21,22 for securing band 20 to racquet 50. In the preferred embodiment shown, band 20 is interwoven with a plurality of main strings 72, in a stretched condition and fasteners 40 attach to main strings toward the sides.

Figure 2:
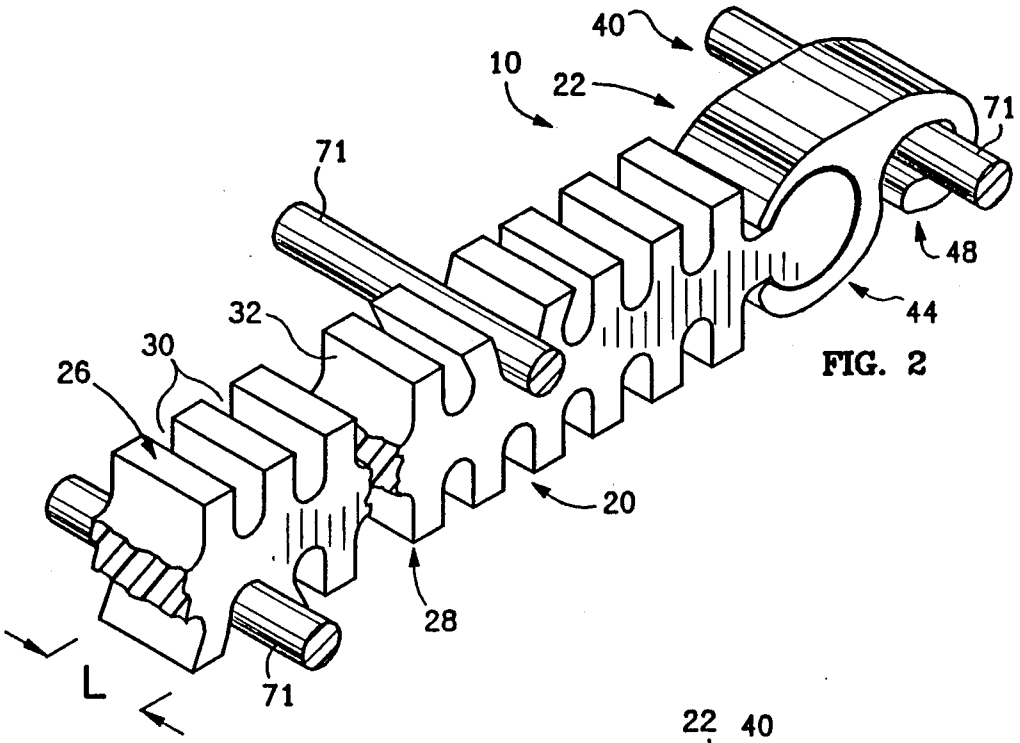
FIG. 2 is a fragmentary perspective of one end of the exemplary embodiment of the damping device shown in FIG. 1.
Figure 3:
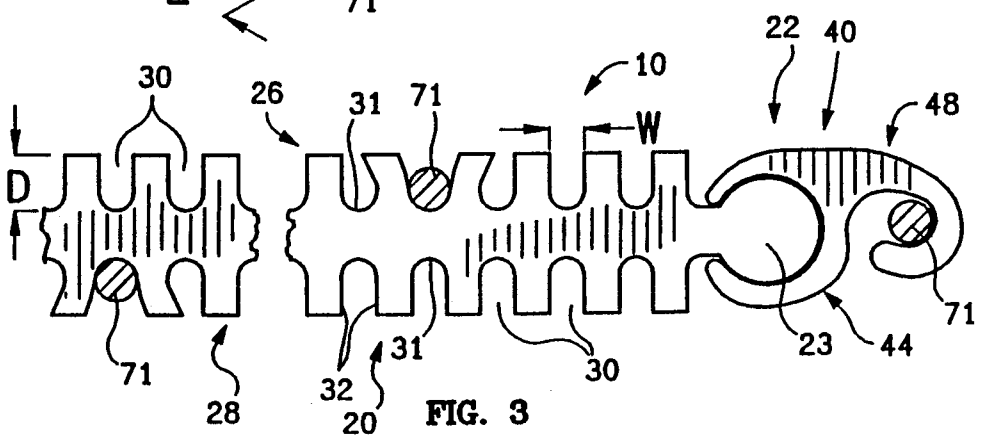
FIG. 3 is a side elevation view of the device of FIG. 2.

Turning now to FIGS. 2 and 3, a section of vibration damping device 10 including fastener 40 is shown. FIG. 2 is a fragmentary perspective of one end 22 of the exemplary embodiment of the damping device shown in FIG. 1 shown partially broken away. FIG. 3 is a side elevation view of the device 10 of FIG. 2. The other end 21 is the equivalent.

In the preferred embodiment, band 20 is rectangular in transverse cross-section and includes top and bottom sides denoted generally as 26 and 28. Each side 26,28 includes a plurality of transverse channels 30. Each channel has side walls 32 and a bottom 31. A channel 30 is designed to receive one of the interwoven strings 71. Channel 30 of the preferred embodiment is U-shaped in cross-section. Preferably, a U-shaped or rectangular channel 30 has a width W equal to or less than the width of string 71 and has a depth D equal to or greater than one-half the width of string 71.

Preferably, channel bottom 31 bears against string 71 and channel side walls 32 bear against opposite sides of string 71. In the preferred embodiment shown, channel width W is slightly less than string width such that channel walls 32 fit tightly against opposite sides of string 71, perhaps such that walls 32 are slightly deformed as show. Preferably also, the force of the tensioned interweaving of band 20 causes the bottom 31 of channel 30 to bear against string 71.

With a band 20 shown of rectangular cross-section, each channel 30 has a length L of the band width for bearing against the string. Other factors being equal, the more contact area between damping device 10 and string, the greater the damping effect. A contact channel length L of approximately three or four times the string width has been found to produce preferred damping results without significant degradation of other racquet parameters, such as weight, balance, and wind resistance.

Each end 21,22 of band 20 is adapted for attachment of a securing device 40. Transverse enlargement 23 provides a means by which hook fastener 40 slidingly attaches to band 20 from the side or transversely to the longitudinal axis. Hook fastener 40 includes a sliding attachment portion 44 for transverse sliding attachment the band enlargement 23 and a hook portion 48 for attachment to a string 71.

Having described the invention, it can be seen that it provides an improved device for damping string vibration.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

We claim:

1. A device for damping vibrations for a sports racquet having sets of interwoven strings defining a striking surface; said device comprising:

an elongated band having a longitudinal axis and composed of elastic flexible material; said band including:

a first end; and a second end opposite said first end; and securing means attached to said first end and to said second end for securing said band in a stretched condition between said opposite ends to a tennis racquet in an interwoven relationship with a plurality of strings on the racquet striking surface; said band further including:

a plurality of channels therein; each said channel including side walls; each said channel for receiving a string interwoven with said band such that said channel side walls bear against opposite sides of the string.

2. The device of claim 1 wherein:

said band is substantially rectangular in transverse cross-section and said channels traverse the width of said band.

3. The device of claim 1 wherein:

said channels are substantially U-shaped in cross-section.

4. The device of claim 1 wherein:

said channels are substantially rectangular in cross-section.

5. The device of claim 1 wherein:

said securing means is adapted to secure each said band end to a racquet string.

6. The device of claim 5 wherein:

each securing means includes a rigid hook member for fastening to a string.

7. A device for damping vibrations for a sports racquet having sets of interwoven strings defining a striking surface; said device comprising:

an elongated band having a longitudinal axis and composed of elastic flexible material; said band including:

a first end adapted for sliding attachment from the side of a securing device; and a second end opposite said first end adapted for sliding attachment from the side of a securing device; and securing devices slidingly attached from the side to said first end and to said second end for securing said band in a stretched condition between said opposite ends to a tennis racquet in an interwoven relationship with a plurality of strings on the racquet striking surface; said band further including:

a plurality of channels therein; each said channel including side walls; each said channel for receiving a string interwoven with said band such that said channel side walls bear against opposite sides of the string.

8. The device of claim 7 wherein:

each said securing device includes a rigid hook member adapted for attachment to a racquet string.

9. The device of claim 7 wherein:

said band is substantially rectangular in transverse cross-section and said channels traverse the width of said band.

10. The device of claim 7 wherein:

said channels are substantially U-shaped in cross-section.

11. The device of claim 7 wherein:

said channels are substantially rectangular in cross-section.

12. In combination:

a sports racquet having:

a plurality of spaced apart interwoven strings defining a striking surface; and a device for damping vibrations in said sports racquet comprising:

an elongated band having a longitudinal axis and composed of elastic flexible material; said band including:

a first end; and a second end opposite said first end; and securing means attached to said first end and to said second end for securing said band in a stretched condition between said opposite ends to said tennis racquet in an interwoven relationship with a plurality of said strings on said racquet striking surface; said band further including:

a plurality of channels therein; each said channel including side walls; each said channel for receiving a said string interwoven with said band such that said channel side walls bear against opposite sides of said string.

13. The device of claim 12 wherein:

said channels have a depth equal to or greater than one half the width of said received string.

14. The device of claim 12 wherein:

said channels have a width equal to or less than the width of said string.

15. The device of claim 13 wherein:

said channels have a width equal to or less than the width of said string.

16. The device of claim 15 wherein:

said band is substantially rectangular in transverse cross-section with a width greater than three times the width of said received string and said channels traverse the width of said band.

17. The device of claim 12 wherein:

said band is substantially rectangular in transverse cross-section with a width greater than three times the width of said received string and said channels traverse the width of said band.

18. The device of claim 17 wherein:

said channels have a depth equal to or greater than one half the width of said received string.

19. The device of claim 17 wherein:

said channels have a width equal to or less than the width of said received string.

* * * * *